US006474032B1

(12) United States Patent
Wynn

(10) Patent No.: US 6,474,032 B1
(45) Date of Patent: Nov. 5, 2002

(54) BRICK POCKET

(76) Inventor: Charles D. Wynn, 34 County Rd. 1059, Vinemont, AL (US) 35179

( * ) Notice: Subject to any disclaimer, the term of this patent is extended or adjusted under 35 U.S.C. 154(b) by 0 days.

(21) Appl. No.: 09/964,417

(22) Filed: Sep. 28, 2001

(51) Int. Cl.[7] ..... E04B 2/00

(52) U.S. Cl. ..... 52/405.2; 52/94; 52/518; 52/96; 52/97; 52/60

(58) Field of Search ..... 52/94, 97, 60, 52/96

(56) References Cited

U.S. PATENT DOCUMENTS 3,206,806 A * 9/1965 Powell ..... 52/241
3,242,622 A * 3/1966 Snead ..... 52/364
3,332,180 A * 7/1967 Price ..... 52/60
3,344,566 A * 10/1967 Miles et al. ..... 52/94
3,738,068 A * 6/1973 Attaway ..... 52/60
3,783,564 A * 1/1974 Dunn et al. ..... 52/74
4,689,925 A 9/1987 Granieri
4,843,783 A * 7/1989 Taravella ..... 52/212
5,243,800 A * 9/1993 Olbrich ..... 52/220.1
5,444,953 A * 8/1995 Koenig et al. ..... 52/255
5,657,585 A * 8/1997 Zaccagni ..... 52/518
5,836,113 A * 11/1998 Bachman ..... 52/287.1
5,850,717 A * 12/1998 Schiedegger et al. ..... 52/287.1

FOREIGN PATENT DOCUMENTS

JP 6307002 11/1994

* cited by examiner

*Primary Examiner*—Yvonne M. Horton
*Assistant Examiner*—Basil Katcheves
(74) *Attorney, Agent, or Firm*—Richard C. Litman

(57) ABSTRACT

A brick prefabricated pocket construction element which becomes part of a cornice of a building under construction comprising a molded form made of metal, plastic, or vinyl, that is positioned on top of a brick wall facing. The device includes a soffit pocket. The brick pocket eliminates lumber for brick pockets and reduces maintenance. The brick pocket comprises a flat backplate with screw holes adjacent the top and bottom edges. A horizontal lip or soffit flange is positioned below the screw holes adjacent the top edge of the backplate. A cover wall is spaced below the horizontal lip. The horizontal plate extends from the back plate and has a vertical face or outer wall that extends downward and is spaced from the back plate to form the brick pocket. The space between the horizontal lip and the horizontal plate forms the soffit pocket.

6 Claims, 4 Drawing Sheets

BRICK POCKET

BACKGROUND OF THE INVENTION

1. Field of the Invention

The present invention relates to a construction element. More particularly, the invention is a brick pocket forming part of a building cornice.

2. Description of the Related Art

U.S. Pat. No. 5,850,717, issued Dec. 22, 1998, to Schiedegger et al. describes dentil molding apparatus for securing a molding insert member and an optional soffit-engaging upper lip portion. The device may be positioned so that it abuts the top most row of bricks. The '717 patent describes a particular type of exterior molding and does not provide for a brick pocket and soffit groove of substantial length where a dentil molding is not desired.

U.S. Pat. No. 5,657,585, issued Aug. 19, 1997, to Zaccagni describes a combination siding panel-trimming and soffit-panel mounting member extruded in one piece from a polymeric material such as polyvinyl chloride. The '585 patent does not describe a brick pocket having a soffit groove.

U.S. Pat. No. 4,689,925, issued Sep. 1, 1987, to Granieri describes a cornice between a wall and a ceiling, both made of modular panels. One portion sits on top of the wall and the other portion receives the ceiling. The cornice is made of lightweight material which is enveloped in a metal sheet. The '925 patent does not describe a brick pocket with a soffit groove.

U.S. Pat. No. 3,206,806, issued Sep. 21, 1965, to Powell describes a corner strip member for interconnecting construction panels. The '806 patent does not describe a brick pocket with soffit groove as in the present invention.

None of the above inventions and patents, taken either singularly or in combination, is seen to describe the instant invention as claimed. Thus, a brick pocket solving the aforementioned problems is desired.

SUMMARY OF THE INVENTION

The present invention is a brick pocket construction element which becomes part of a cornice of a building under construction comprising a molded form made of metal, plastic, or vinyl, that is positioned on top of a brick wall facing. The device includes a soffit pocket for vinyl or metal soffit. The brick pocket eliminates the use of lumber for brick pockets and reduces maintenance. The brick pocket comprises a flat backplate with screw holes adjacent the top and bottom edges. A horizontal lip acting as a soffit flange is positioned below the screw holes adjacent the top edge of the backplate. A horizontal plate acting as a brick cover wall is spaced below the horizontal lip. The horizontal plate extends from the back plate and has a vertical face or outer wall that extends downward and is spaced from the back plate to form the brick pocket. The space between the horizontal lip and the horizontal plate forms the soffit pocket.

Accordingly, it is a principal object of the invention to provide a brick pocket for use in construction of building cornices.

It is another object of the invention to provide a brick pocket constructed of molded or formed metal, plastic, or vinyl, for positioning on top of a brick wall.

It is a further object of the invention to provide a brick pocket having a soffit pocket for vinyl or metal soffit.

Still another object of the invention is to provide a brick pocket which eliminates the need of lumber for brick pockets, thus reducing maintenance.

Yet another object of the invention is to provide a brick pocket which has a finished surface and reduces installation time.

Still another object of the invention is to reduce the amount of caulking required in construction.

Yet another object of the invention is to make a brick pocket which is simple and easy to install.

Still another object of the invention is to provide a brick pocket which is effective to avoid entrance of rain or water which wets the building.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a brick prefabricated pocket construction element which becomes part of a cornice of a building under construction comprising a molded form made of metal, plastic, or vinyl, that is positioned on top of a brick wall facing. The device includes a soffit pocket for vinyl or metal soffit. The brick pocket eliminates the use of lumber for brick pockets and reduces maintenance. The brick pocket comprises a flat backplate with screw holes-adjacent the top and bottom edges. A horizontal lip or soffit flange is positioned below the screw holes adjacent the top edge of the backplate. A horizontal plate or cover wall is spaced below the horizontal lip. The horizontal plate extends from the back plate and has a vertical face or outer wall that extends downward and is spaced from the back plate to form the brick pocket. The space between the horizontal lip and the horizontal plate forms the soffit pocket.

Figure 1:
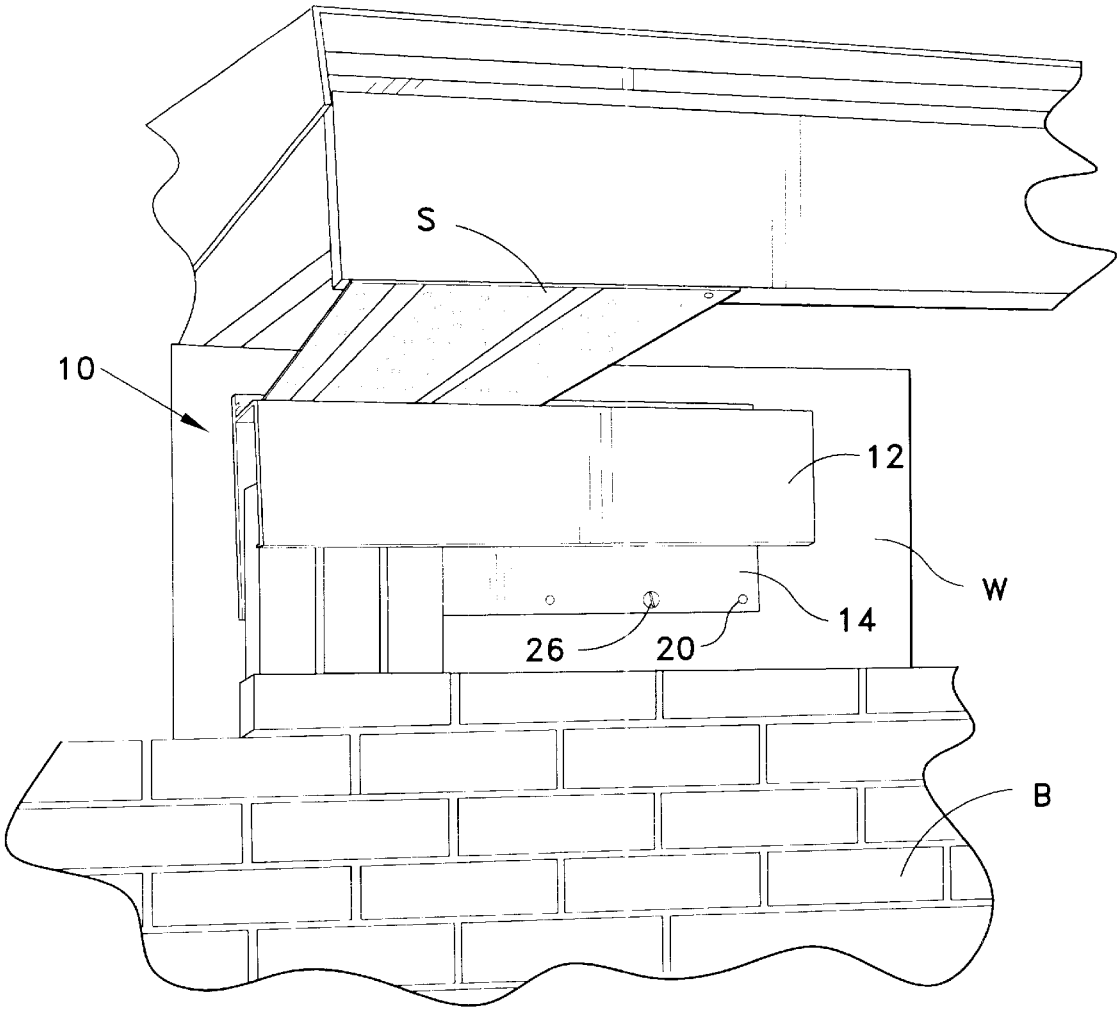
FIG. 1 is an environmental, perspective view of a brick pocket according to the present invention.

Referring to FIG. 1, there is shown an environmental perspective view of the inventive brick pocket 10. Brick pocket 10 is mounted on building outer wall W and holds soffit S above brick siding B. Brick pocket 10 has a back plate 14 attached to wall W so as to support soffit S and has descending outer wall 12 covering an upper portion of brick siding B.

Figure 2:
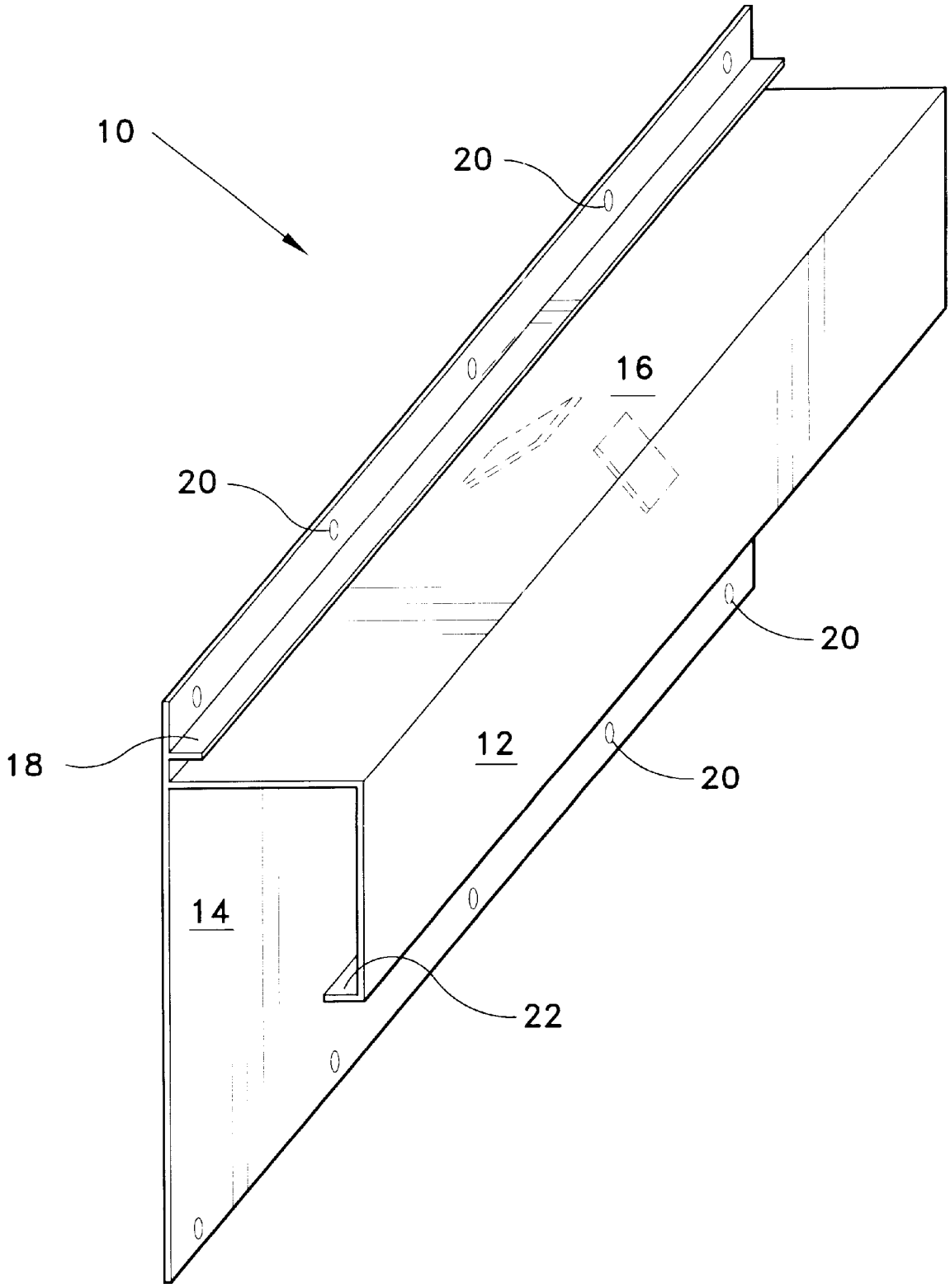
FIG. 2 is a perspective view of the brick pocket of FIG. 1.

Referring to FIG. 2, there is shown a perspective view of the brick pocket 10 of FIG. 1 comprising generally rectangular outer wall 12, and generally rectangular back plate 14 spaced from outer wall 12 by cover wall 16 which covers brick B. Cover wall 16 is perpendicular to the upper edge of outer wall 12 and along an upper portion of back plate 14 spaced from and parallel to the upper edge of back plate 14. Soffit flange 18 is mounted perpendicular to back plate 14 parallel to and so spaced above cover wall 16 as to form a soffit pocket between cover wall 16, soffit flange 18 and back plate 14 so as to receive the ends of soffits and support them on cover wall 16. Attachment bores 20 are spaced along the upper portion of back plate 18 and spaced above soffit flange 18 Attachment bores 20 are also spaced along the lower portion of back plate 14 and provide for tight and secure attachment to wall W. Spacing flange 22 is provided along the lower edge of outer wall 12 and extends toward the brick siding B, spacing outer wall 12 from the brick.

Figure 3:
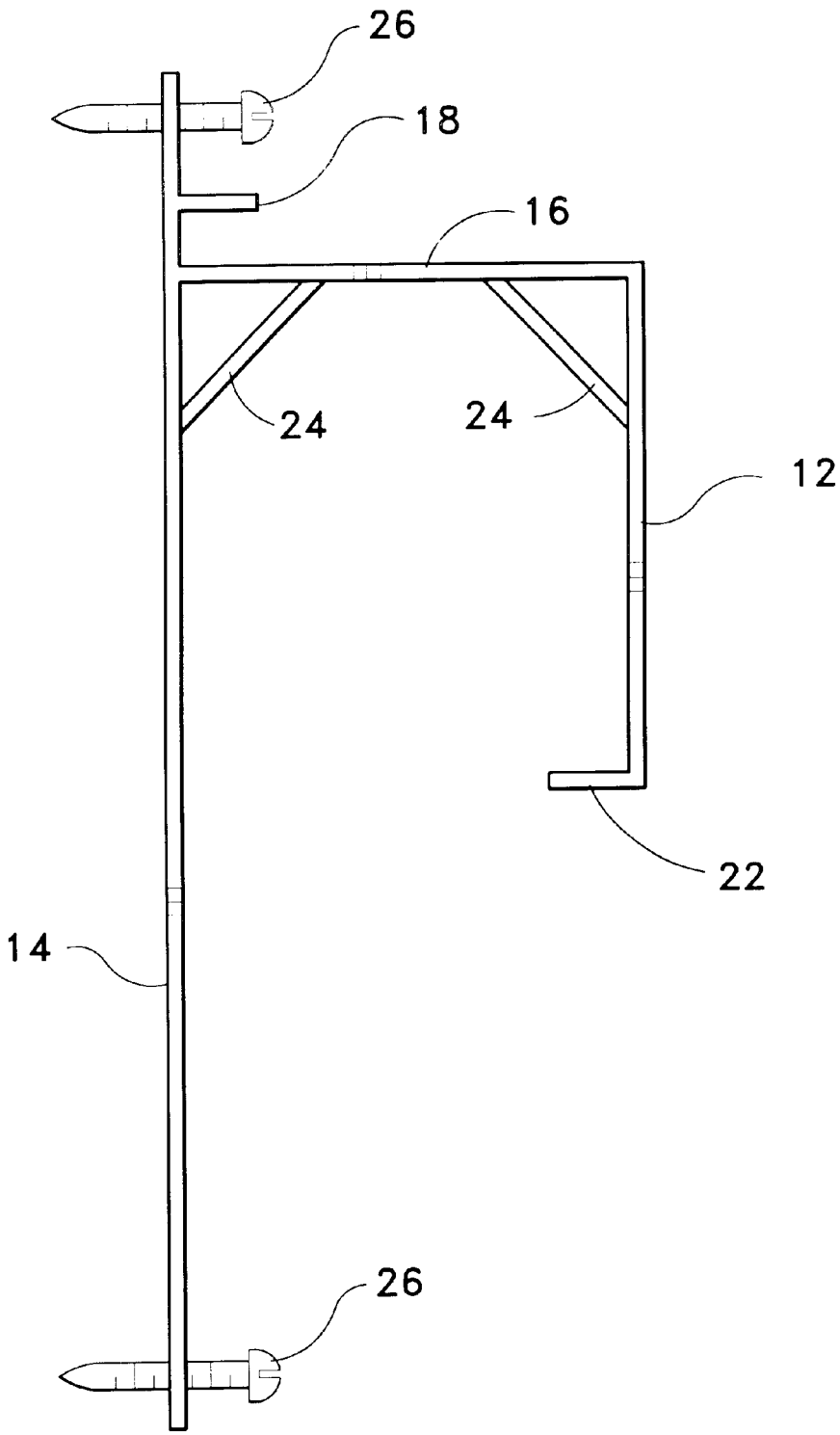
FIG. 3 is an end view of the inventive brick pocket of FIG. 1.

Referring to FIG. 3, there is shown an end view in elevation of brick pocket 10 showing outer wall 12, back plate 14, cover wall 16 soffit flange 18, mounting bores 20, and brick spacing flange 22, as described above. Center braces 24 are optionally provided bracing the overall structure. Screws 26 secure back plate 14 to wall W by means of mounting bores 20.

Figure 4:
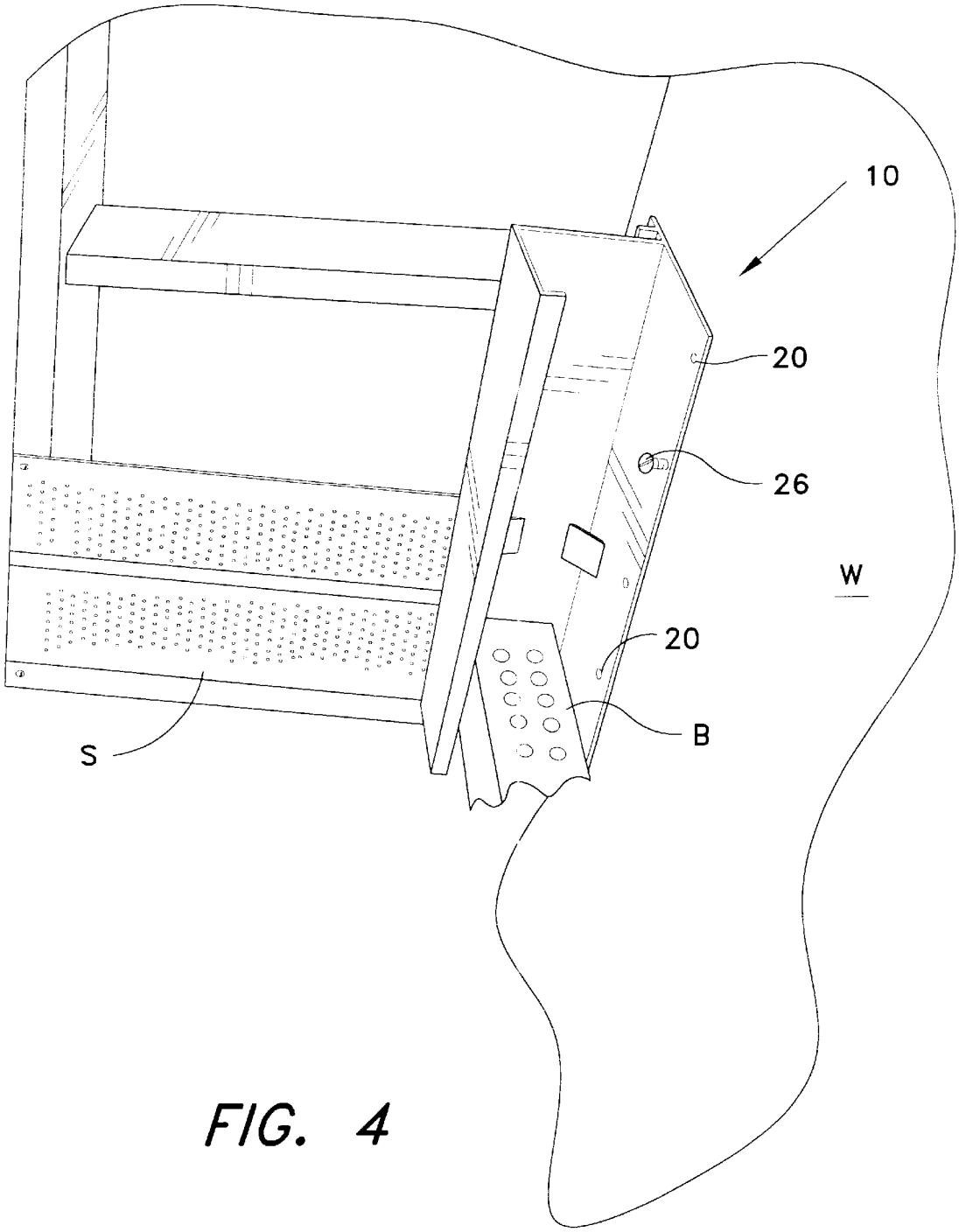
FIG. 4 is a lower environmental perspective view of the inventive brick pocket of FIG. 1.

Referring to FIG. 4, there is shown a lower environmental perspective view of the brick pocket 10. Brick B is shown abutting the lower side of the cover wall of brick pocket 14 with the brick spacing flange abutting the side of brick B. Brick pocket 10 is supporting one end portion of soffit S.

The inventive brick pocket may be constructed of plastic, such as polyvinyl chloride, or sheet metal.

EXAMPLE

A representative brick pocket is molded or bent into a form of plastic or metal twelve feet long and having a ten-inch high flat back plate having one-eighth inch screw holes one inch from the top back plate having one-eighth inch screw holes one inch from the top edge and the bottom edge, respectively, at sixteen inch intervals therealong. A one inch soffit flange is mounted at a right angle two inches down from the top edge of the back plate. Two and one half inches down from the upper edge of the back plate is installed a right angle horizontal forming the cover wall and being between four and three-quarters up to six inches wide. The horizontal is creased and bent downward to form a right angle vertical outer wall about five and one-half inches in height. The vertical outer wall is creased and bent inward toward the back plate at a right angle and extends one-half inch to form a brick spacing flange. Optionally there are braces spaced at two foot intervals along the upper interior of the brick pocket. The resulting structure acts both as a brick pocket, i.e., a point at which to end brick siding of a wooden house, and as a soffit pocket to hold metal or vinyl soffit.

It is to be understood that the present invention is not limited to the embodiments described above, but encompasses any and all embodiments within the scope of the following claims.

I claim:

1. A prefabricated brick pocket comprising:

a vertically oriented, back plate extending horizontally lengthwise and having an upper edge and a lower edge;

a cover wall extending outward from said vertical back plate;

means for mounting said vertical back plate along an upper portion of an exterior wall of a structure;

said back plate being so positioned that said cover wall and a outer wall extend over and downward over an upper layer of brick facing, respectively;

a soffit flange spaced downward from said upper edge of said back plate and attached thereto, disposed normal to said back plate, and extending along the length of said back plate;

said cover wall being spaced downward from said soffit flange, disposed normal to said back plate, and attached thereto, parallel to said soffit flange and extending along the length of said back plate;

said outer wall depending from said cover wall and disposed parallel to said back plate, extending along the length thereof and including a lower edge;

said back plate bearing said soffit flange and said cover wall forming a soffit pocket so sized as to receive a standard soffit, said cover wall acting as a support for an end portion of said soffit;

a brick spacing flange extending along and perpendicular to said outer wall along its lower edge toward said back plate; and braces disposed within said pocket including a first set of braces extending at an angle from said cover wall to said brick pocket back plate and a second set of braces extending at a similar angle from said cover wall and said outer wall.

2. The prefabricated brick pocket of claim 1, wherein:

said brick pocket is about twelve feet long;

said back plate is about ten inches in height;

said soffit flange is about one inch in width and mounted about two inches below said upper edge of said back plate; said cover wall being between about four and three quarters and about six inches in height; and said brick spacing flange being about one-half inch in width.

3. The prefabricated brick pocket of claim 2, wherein said supports are spaced at about two-foot intervals within said brick pocket.

4. The prefabricated brick pocket of claim 2, wherein said means for mounting said vertical back plate comprise mounting bores defined by said back plate and extending along the length of said back plate.

5. The prefabricated brick pocket of claim 4, wherein said mounting bores are spaced along said back plate in a first row spaced below and adjacent said upper edge, and a second row spaced above and adjacent said lower edge.

6. The prefabricated brick pocket of claim 5, further comprising braces disposed within said pocket including a first set of braces extending at an angle from said cover wall to said brick pocket back plate and a second set of braces extending at a similar angle from said cover wall and said outer wall.

* * * * *